US012588740B2

(12) United States Patent
Bennett

(10) Patent No.: US 12,588,740 B2
(45) Date of Patent: Mar. 31, 2026

(54) ADJUSTABLE BRACELET

(71) Applicant: Allison Bennett, Griswold, CT (US)

(72) Inventor: Allison Bennett, Griswold, CT (US)

( * ) Notice: Subject to any disclaimer, the term of this patent is extended or adjusted under 35 U.S.C. 154(b) by 42 days.

(21) Appl. No.: 18/397,452

(22) Filed: Dec. 27, 2023

(65) Prior Publication Data

US 2024/0206599 A1 Jun. 27, 2024

Related U.S. Application Data

(60) Provisional application No. 63/435,338, filed on Dec. 27, 2022.

(51) Int. Cl.
*A44C 5/00* (2006.01)
*A44C 27/00* (2006.01)

(52) U.S. Cl.
CPC ..... *A44C 5/0053* (2013.01); *A44C 27/00* (2013.01)

(58) Field of Classification Search
CPC ..... A44C 5/0053; A44C 5/00; A44C 5/022; A44C 5/025; A44C 5/18; A44C 5/20
USPC ..... 63/3, 3.1, 6.2, 23, 37
See application file for complete search history.

(56) References Cited

U.S. PATENT DOCUMENTS

| | | | | | |
|---|---|---|---|---|---|
| 1,419,370 | A | * | 6/1922 | Genaille | A44C 5/00 24/712 |
| D386,999 | S | | 12/1997 | Kothari | |
| D487,709 | S | | 3/2004 | Ferlise | |
| D645,375 | S | * | 9/2011 | Alpert | D11/16 |
| D669,385 | S | | 10/2012 | Rafaelian | |
| D731,348 | S | | 6/2015 | Vangell | |
| D873,696 | S | | 1/2020 | Nyaggah | |
| D895,472 | S | | 9/2020 | Nyaggah | |
| D966,134 | S | * | 10/2022 | Li | D11/5 |
| D980,107 | S | * | 3/2023 | Chen | D11/5 |
| 12,285,085 | B1 | * | 4/2025 | Proulx | A44C 5/025 |
| 2015/0114038 | A1 | * | 4/2015 | Loden | A44C 5/0053 63/3 |
| 2019/0029374 | A1 | * | 1/2019 | Goldberg | A44C 17/0241 |

* cited by examiner

*Primary Examiner* — Jack W Lavinder
(74) *Attorney, Agent, or Firm* — CANTOR COLBURN LLP

(57) ABSTRACT

A jewelry bracelet includes a first strap having a first strap first end, a first strap second end and a first strap length, a second strap having a second strap first end, a second strap second end and a second strap length, wherein the first strap first end is tied to the second strap along the second strap length and the second strap first end is tied to the first strap along the first strap length to define a bracelet cavity, a plurality of bead lines, wherein the plurality of bead lines are associated with the first strap and the second strap via a mounting thread to be securely and tightly disposed within the bracelet cavity and a center ring defining a center ring cavity, wherein the first strap second end and the second strap second end are securely associated with the center ring to define a wrist cavity.

6 Claims, 14 Drawing Sheets

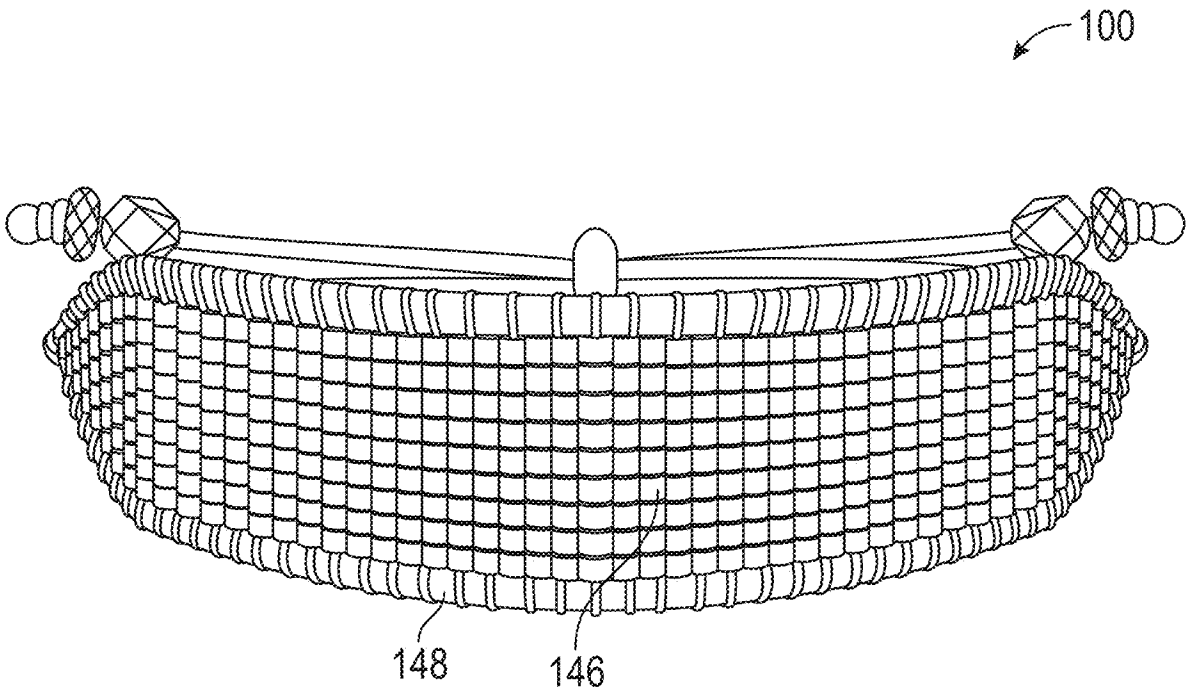
FIG. 3
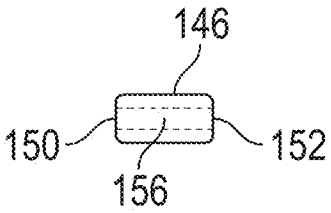

ADJUSTABLE BRACELET

RELATED APPLICATIONS

This application is related to and claims the benefit of priority of the filing date of U.S. Provisional Patent Application Ser. No. 63/435,338, filed on Dec. 27, 2022, the content of which is incorporated herein by reference in its entirety.

TECHNICAL FIELD

The present invention relates generally to a jewelry article, and more particularly to an adjustable sized bracelet article having seed beads, leather and gemstones that are used for energy protection and healing.

BACKGROUND OF THE INVENTION

Jewelry bracelets are well known and have been made, sold and worn for hundreds, if not thousands, of years. The elements of a bracelet typically include a bracelet wrist strap, a decorative element (such as a bead or gemstone) and an associating means to connect the ends of the wrist strap together. When the ends of the wrist strap are wrapped around the wrist of a wearer and connected, the bracelet wrist strap defines a wrist cavity which encloses the wrist within the wrist cavity to secure the bracelet on the wrist of the wearer. Bracelet wrist straps are known to be made out of many various materials and combinations of materials, such as leather, rope, metal, rubber, ceramic and plastics and they include many different types of associating means which are used fasten the ends of the straps together and which include fasteners, clasps, clips, snaps, etc.

Unfortunately, however the available types of associating means are typically unattractive, hard to secure together with one hand and they are not able to be configured for different sized wrists. Additionally, the current types of associating means loosen fairly easily allowing for a situation where the bracelet may fall or slip off of the wearer's wrist.

SUMMARY

A method for creating a jewelry bracelet is provided and includes obtaining a first strap having a first strap first end and a first strap second end, a second strap having a second strap first end and a second strap second end, a plurality of beads and a bead mounting thread. The method further includes tying the first strap first end to the second strap to form a first knot, securing one end of the bead mounting thread to the first strap, creating a bead line by, threading the bead mounting thread through one or more of the plurality of beads to create the bead line, wherein one end of the line of beads is tightly and securely disposed proximate to first strap, securing the bead mounting thread to the second strap such that there is an excess length of bead mounting thread and such that the other end of the bead line is tightly and securely disposed proximate to the second strap to be located between the first strap and the second strap and repeating the creating a bead line with the excess length of bead mounting thread until a plurality of bead lines are disposed between the first strap and the second strap. The method further includes tying the second strap first end to the first strap to form a second knot to form a bracelet cavity between the first strap and the second strap, wherein the plurality of bead lines are securely disposed within the bracelet cavity and associating the first strap second end and the second strap second end with a center ring.

A jewelry bracelet is provided and includes a first strap having a first strap first end, a first strap second end and a first strap length, a second strap having a second strap first end, a second strap second end and a second strap length, wherein the first strap first end is tied to the second strap along the second strap length and the second strap first end is tied to the first strap along the first strap length to define a bracelet cavity, a plurality of bead lines, wherein the plurality of bead lines are associated with the first strap and the second strap via a mounting thread to be securely and tightly disposed within the bracelet cavity and a center ring defining a center ring cavity, wherein the first strap second end and the second strap second end are securely associated with the center ring to define a wrist cavity.

Additional technical features and benefits are realized through the techniques of the present invention. Embodiments and aspects of the invention are described in detail herein and are considered a part of the claimed subject matter. For a better understanding, refer to the detailed description and/or to the drawings.

BRIEF DESCRIPTION OF THE DRAWINGS

The foregoing and other features and advantages of the present invention should be more fully understood from the accompanying detailed description of illustrative embodiments taken in conjunction with the following Figures in which like elements are numbered alike in the several Figures:

FIG. 3 shows a top-down view of the jewelry bracelet of FIG. 1, in accordance with an embodiment of the invention.

DETAILED DESCRIPTION

Figure 1:
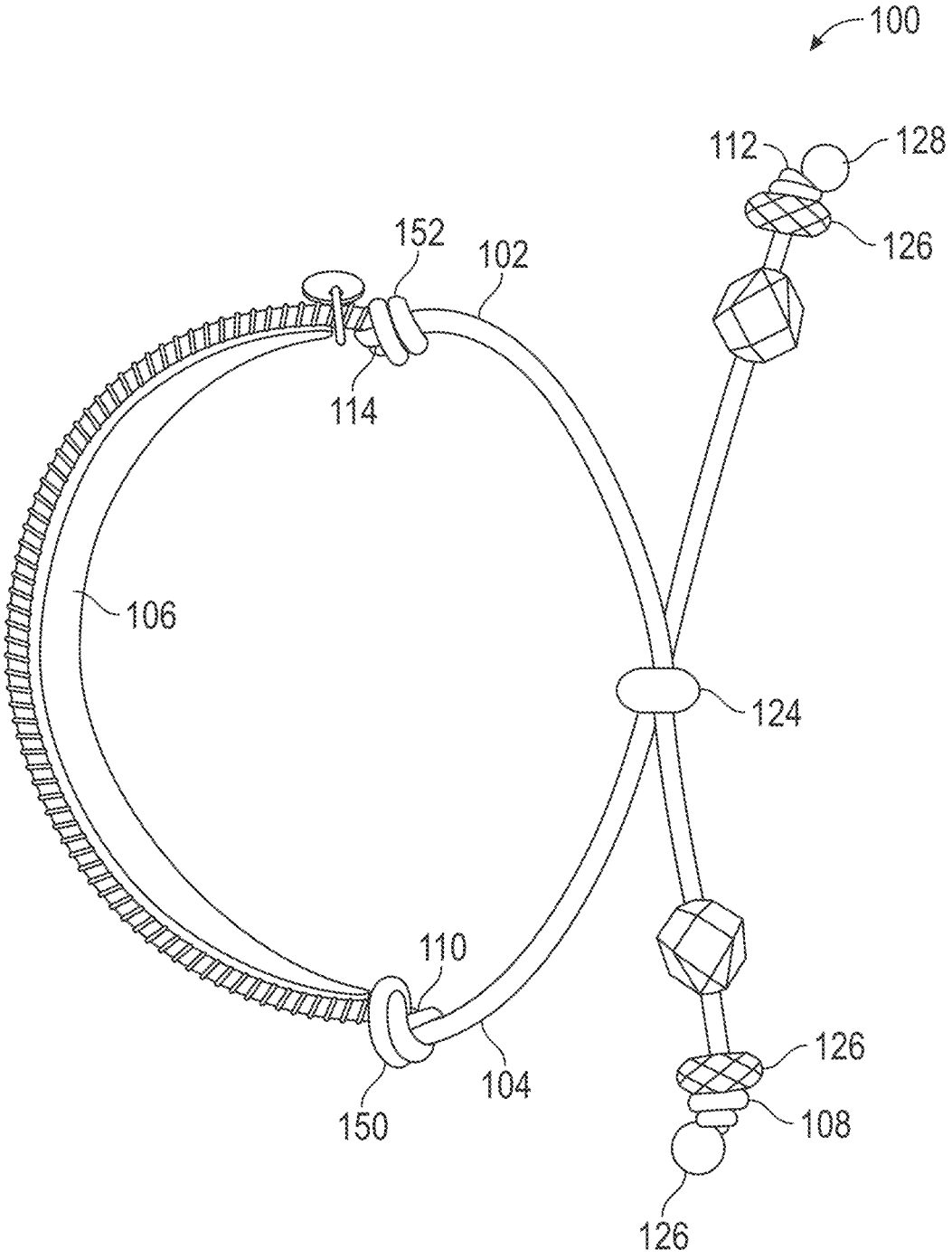
FIG. 1 shows a side view of a jewelry bracelet, in accordance with an embodiment of the invention.
Figure 2:
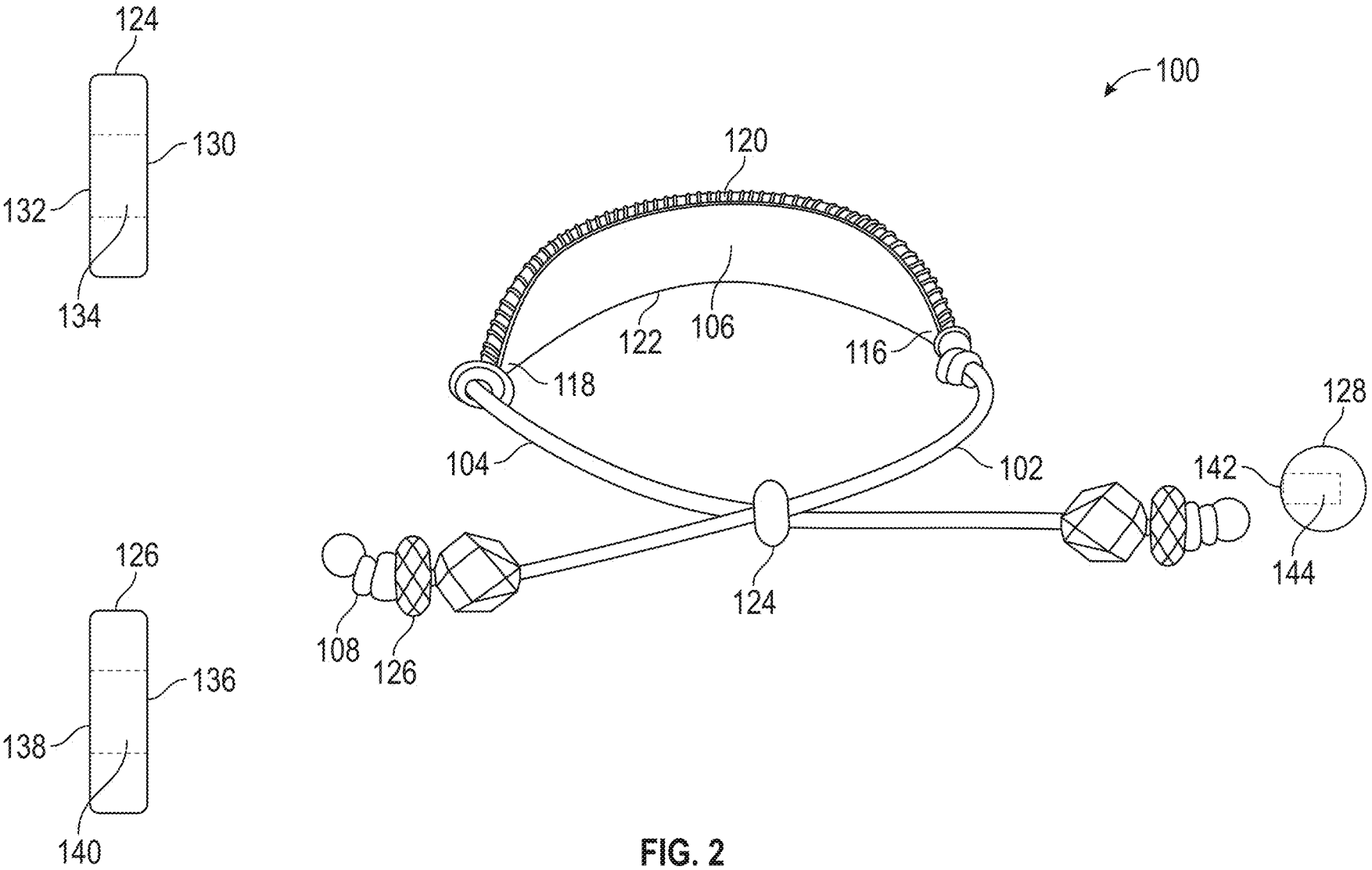
FIG. 2 shows a bottom-up, side view of the jewelry bracelet of FIG. 1, in accordance with an embodiment of the invention.

Referring to FIG. 1, FIG. 2, FIG. 3 and FIG. 4A, a jewelry bracelet 100 is provided and disclosed, in accordance with an embodiment of the invention. The jewelry bracelet 100 includes a first strap (or cord) 102, a second strap (or cord) 104 and a strap center pad 106, wherein the strap center pad 106 is securely associated with the first strap 102 and the second strap 104. The first strap 102 includes a first strap first end 108, a first strap second end 110 and a first strap length. Moreover, the second strap 104 includes a second strap first end 112, a second strap second end 114 and a second strap length. It should be appreciated that the first strap second end 110 is securely tied t and associated with the second strap 104 at a first position along the second strap length to form a first knot 150 located at the first position and the second strap second end 114 is securely tied to and associated with the first strap 102 at a second position along the first strap length to form a second knot 152 located at the second position. This causes the first strap 102 and second strap 104 to define a bracelet cavity 154 located between a portion of the first strap 102, the first knot 150, a portion of the second strap 104 and the second knot 152. It should be appreciated that at least one of the center strap pad 106, a plurality of glass seed beads 146 and at least one bead mounting thread 148 for securely associating the plurality of glass seed beads 146 to the first strap 102 and the second strap 104 will be located within and/or proximate to the bracelet cavity 154.

Figure 4A:
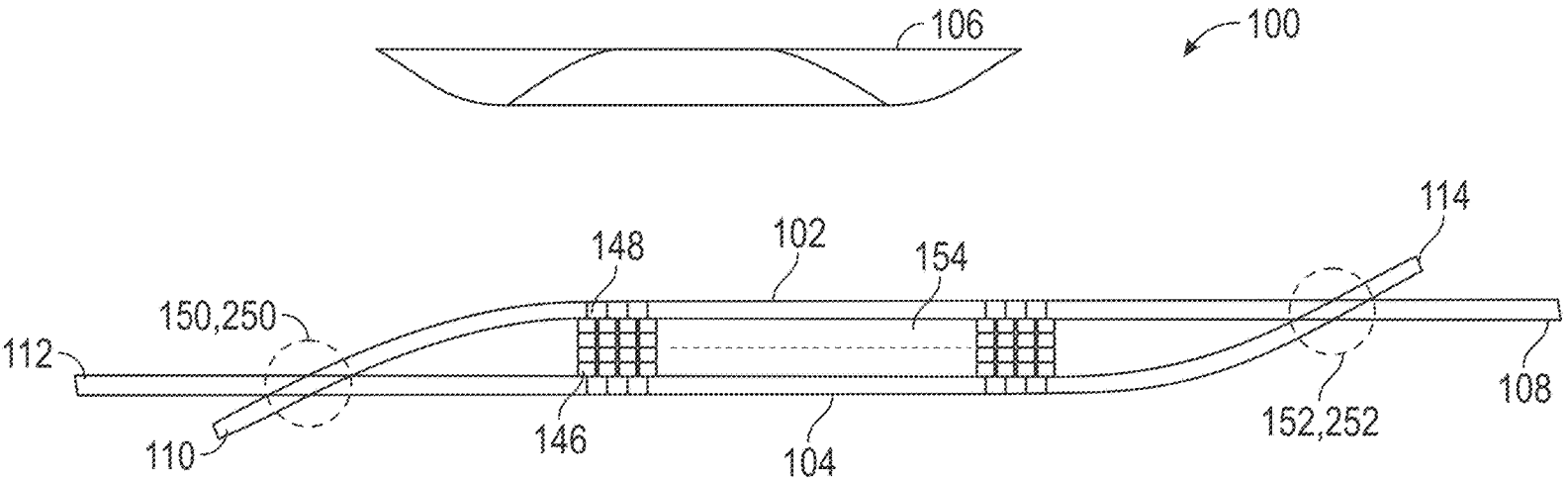
FIG. 4A shows a top-down view of a jewelry bracelet being constructed, in accordance with an embodiment of the invention.
Figure 4B:
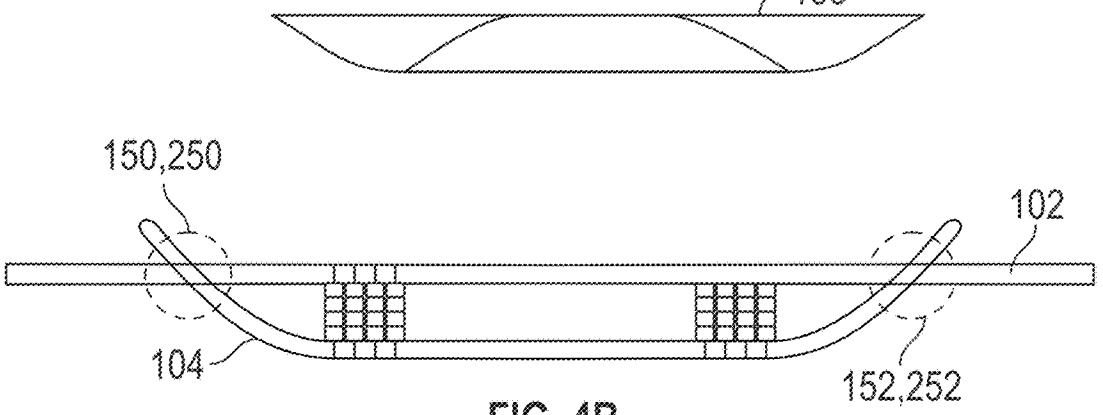
FIG. 4B shows a top-down view of a jewelry bracelet being constructed, in accordance with another embodiment of the invention.

It should be appreciated that FIG. 4B shows another embodiment, where the first strap 102 is used as a main strap and second strap 104 is used as an auxiliary strap to form the bracelet cavity 154.

Additionally, the strap center pad 106 includes a strap center pad first end 116, a strap center pad second end 118, a strap center pad first side 120 and a strap center pad second side 122. The strap center pad 106 is securely associated with the first strap 102 and the second strap 104 to cover an inner side of the bracelet cavity 154, wherein the strap center pad 106 may be securely associated with the first strap 102 and the second strap 104 via any method or device suitable to the desired end purpose, such as an adhesive. It should be further appreciated that the jewelry bracelet 100 further includes a center ring 124, two strap end rings 126 and two strap mounting balls 128. The center ring 124 defines a center ring first opening 130 communicated with a center ring second opening 132 via a center ring cavity 134. It should be appreciated that the center ring cavity 134 is sized to contain a portion of the first strap first end 108, the first strap second end 110, the second strap first end 112 or the second strap second end 114. Moreover, each of the strap end rings 126 define a strap end ring first opening 136 communicated with a strap end ring second opening 138 via a strap end ring cavity 140. It should be appreciated that the strap end ring cavity 140 is sized to contain a portion of the first strap first end 108, the first strap second end 110, the second strap first end 112 or the second strap second end 114. Additionally, each of the strap mounting balls 128 define a mounting ball opening 142 communicated with a mounting ball cavity 144. It should be appreciated that the mounting ball cavity 144 is sized to contain the end portion of the first strap first end 108, the first strap second end 110, the second strap first end 112 or the second strap second end 114.

It should be appreciated that the jewelry bracelet 100 further includes the plurality of glass seed beads 146 and the at least one bead mounting thread 148, wherein the at least one bead mounting thread is associated with the first strap 102 and the second strap 104 to cross over the bracelet cavity 154. Each of the plurality of beads 146 define a bead first opening 150 which is communicated with a bead second opening 152 via a bead cavity 156 and each of the plurality of beads 146 are associated with the at least one bead mounting thread 148 such that the at least one mounting thread 148 traverses the bead first opening 150 and the bead second opening 152 to be at least partially contained within the bead cavity 156. Moreover, the plurality of beads 146 are configured to be securely located within the bracelet cavity 154 between the first strap 102 and the second strap 104. It is contemplated that each of the plurality of beads 146 may contain a design and/or color on its outer surface and may be arranged to form a decorative design.

Figure 5:
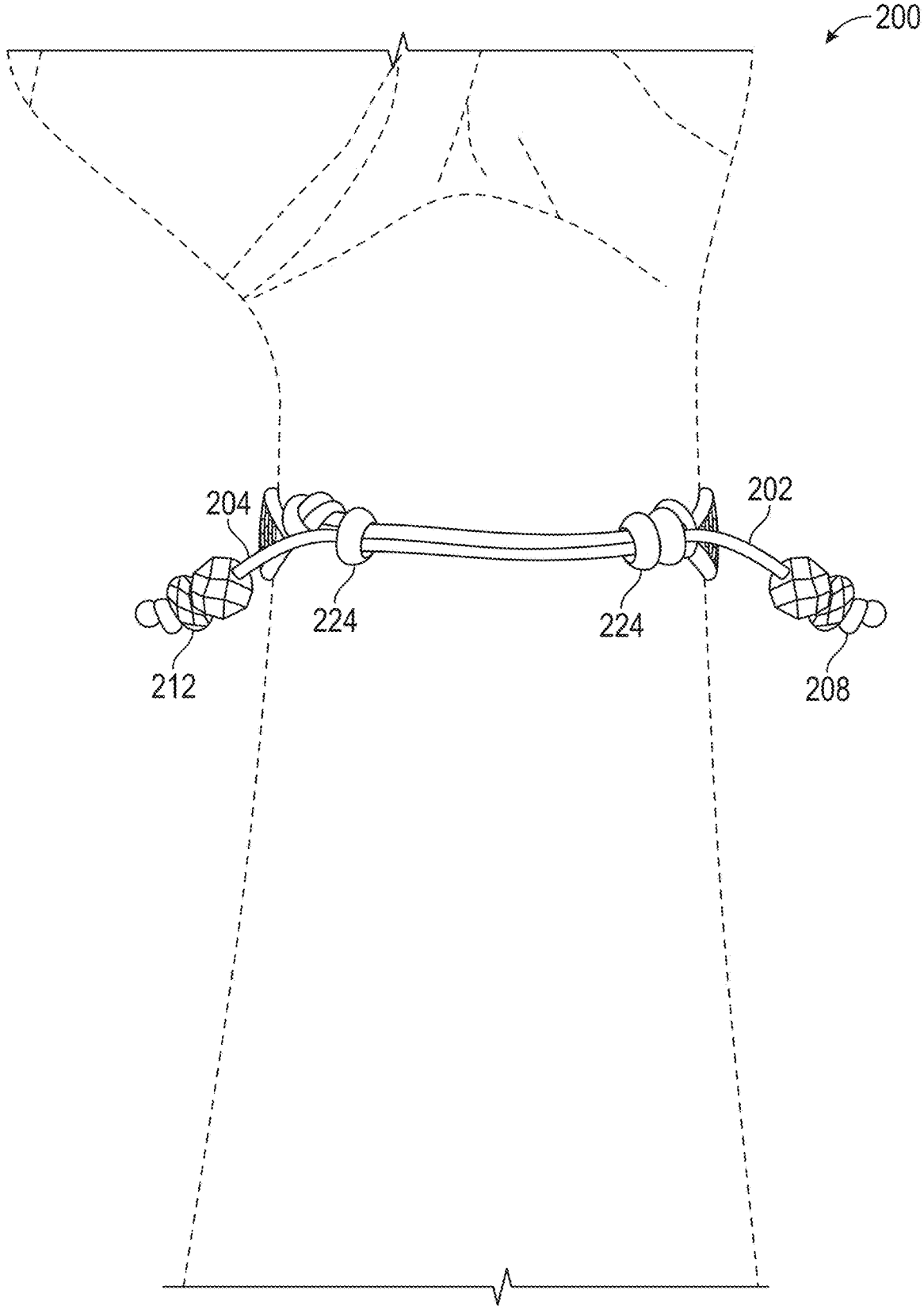
FIG. 5 shows a bottom view of a jewelry bracelet associated with the wrist of a wearer, in accordance with another embodiment of the invention.
Figure 6:
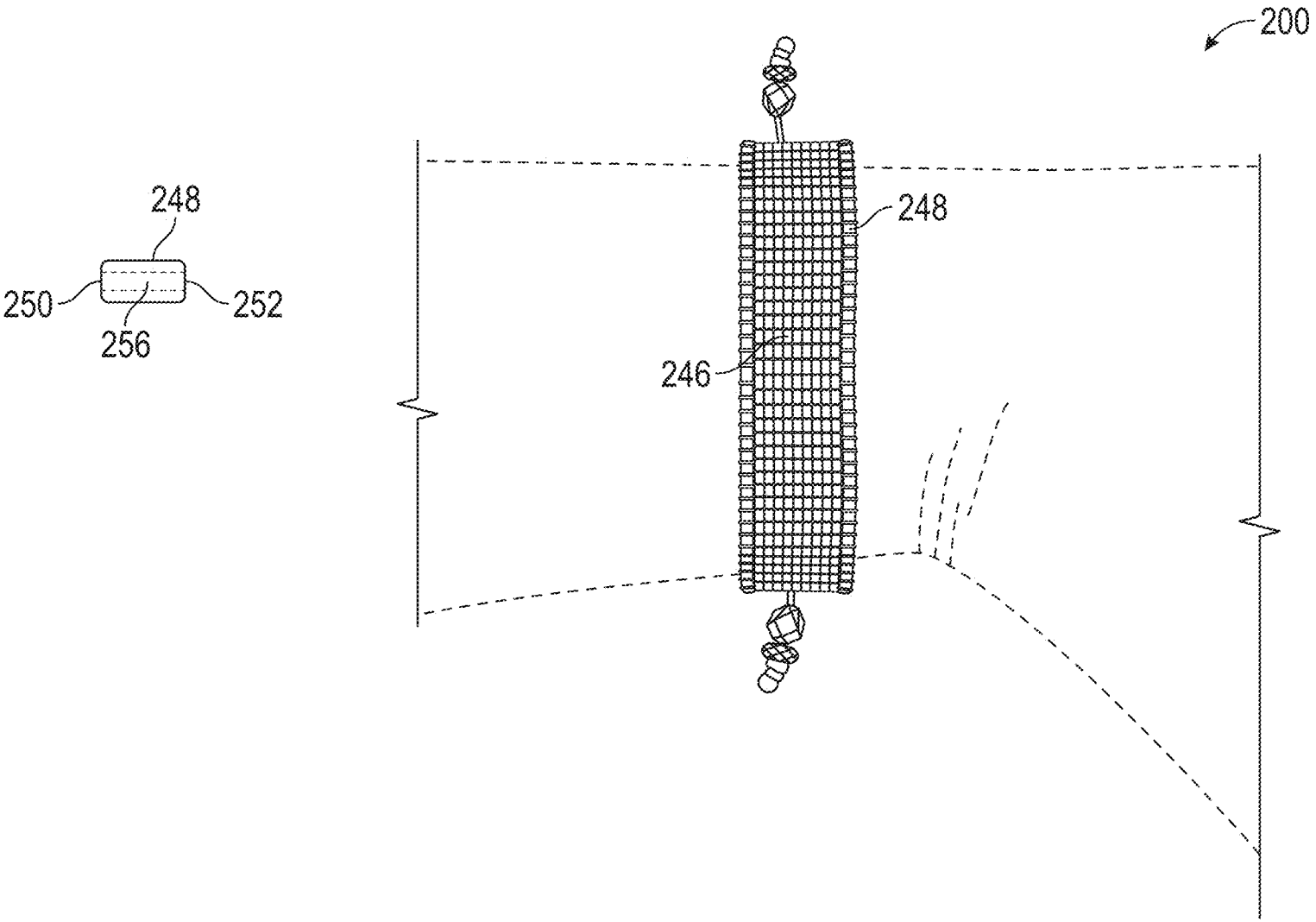
FIG. 6 shows a top-down view of the jewelry bracelet of FIG. 4A associated with the wrist of a wearer, in accordance with still yet another embodiment of the invention.
Figure 7A:
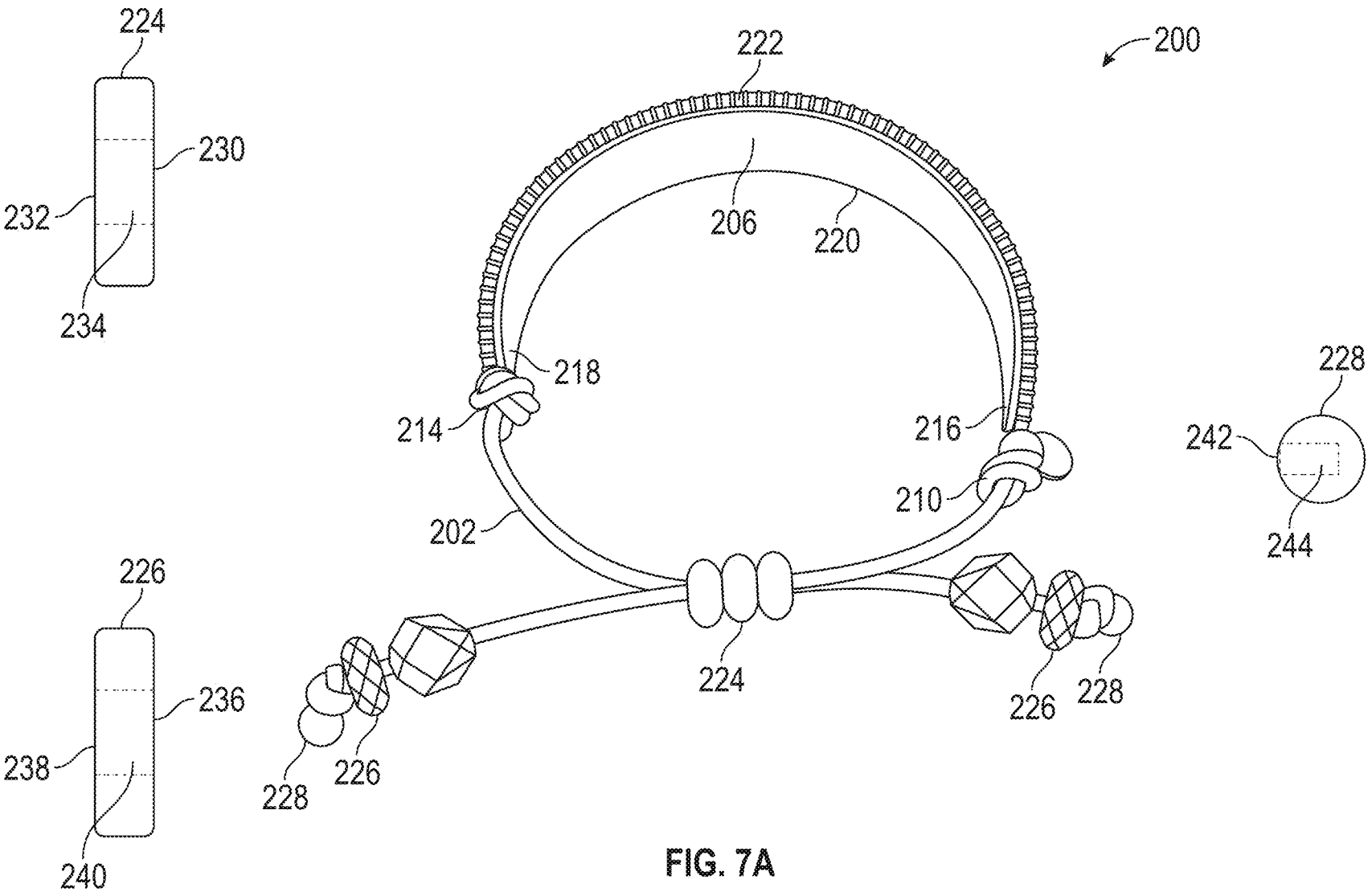
FIG. 7A shows a side view of the jewelry bracelet of FIG. 4A, in accordance with an embodiment of the invention.

Referring to FIG. 5, FIG. 6 and FIG. 7A, a jewelry bracelet 200 is provided and disclosed, in accordance with another embodiment of the invention. The jewelry bracelet 200 includes a first strap 202, a second strap 204 and a strap center pad 206, wherein the strap center pad 206 is securely associated with the first strap 202 and the second strap 204. It should be appreciated that the first strap 202 includes a first strap first end 208, a first strap second end 210 and a first strap length. Moreover, the second strap 204 includes a second strap first end 212, a second strap second end 214 and a second strap length. It should be appreciated that the first strap second end 210 is securely tied to and associated with the second strap 204 to form a first knot 250 at a first position located along the second strap length and the second strap second end 214 is securely tied to and associated with the first strap 202 to form a second knot 252 at a second position located along the first strap length. This causes the first strap 202 and second strap 204 to define bracelet cavity 254 located between the first strap 202, the first knot 250, the second strap 204 and the second knot 252. The center strap pad 206, a plurality of glass seed beads 246 and at least one bead mounting thread 248 for securely associating the plurality of glass seed beads 246 to the first strap 202 and the second strap 204 will be located within and/or proximate to the bracelet cavity 254.

Additionally, the strap center pad 206 includes a strap center pad first end 216, a strap center pad second end 218, a strap center pad first side 220 and a strap center pad second side 222. The strap center pad 206 is securely associated with the first strap 202 and the second strap 204 to cover an inner side of the bracelet cavity 254, wherein the strap center pad 206 may be securely associated with the first strap 202 and the second strap 204 via any method or device suitable to the desired end purpose, such as an adhesive. It should be further appreciated that the jewelry bracelet 200 may further include a plurality of center rings 224, two strap end rings 226 and two strap mounting balls 228. Each of the plurality of center rings 224 define a center ring first opening 230 communicated with a center ring second opening 232 via a center ring cavity 234. It should be appreciated that the center ring cavity 234 is sized to contain a portion of the first strap first end 208, the first strap second end 210, the second strap first end 212 or the second strap second end 214. Moreover, each of the strap end rings 226 define a strap end ring first opening 236 communicated with a strap end ring second opening 238 via a strap end ring cavity 240. It should be appreciated that the strap end ring cavity 240 is sized to contain a portion of the first strap first end 208, the first strap second end 210, the second strap first end 212 or the second strap second end 214. Additionally, each of the strap mounting balls 228 define a mounting ball opening 242 communicated with a mounting ball cavity 244. It should be appreciated that the mounting ball cavity 244 is sized to contain the end portion of the first strap first end 208, the first strap second end 210, the second strap first end 212 or the second strap second end 214.

It should be appreciated that the jewelry bracelet 200 further includes the plurality of glass seed beads 246 and the at least one bead mounting thread 248, wherein the at least one bead mounting thread is associated with the first strap 202 and the second strap 204 to cross over the bracelet cavity 254. Each of the plurality of beads 246 define a bead first opening 250 which is communicated with a bead second opening 252 via a bead cavity 256 and each of the plurality of beads 246 are associated with the at least one bead mounting thread 248 such that the at least one mounting thread 248 traverses the bead first opening 250 and the bead second opening 252 to be at least partially contained within the bead cavity 256. Moreover, the plurality of beads 246 are configured to be securely located within the bracelet cavity 254 between the first strap 202 and the second strap 204. It is contemplated that each of the plurality of beads 246 may contain a design and/or color on its outer surface and may be arranged to form a decorative design.

It should be appreciated that the jewelry bracelet 100, 200 is adjustable in size and is handwoven (i.e., not made using a loom) and includes glass seed beads 146, 246, a first leather strap/cord 102, 202, a second leather strap/cord 104, 204 and one or more gemstones 300. A knot 302 is tied using multiple pieces of the leather cords 102, 202, 104, 204 and the design of the plurality of seed beads 146, 246 is handwoven in between to the multiple pieces of leather cords 102, 202, 104, 204 and then knotted again at the opposite end. The excess of one of the leather cords 102,202, 104, 204 is removed, leaving the remaining ends to be inserted into a mechanism made of silicone within and a metal bead, allowing the bracelet to glide along the leather and adjust to many wrist lengths. Gemstones 300 are added to the ends of each piece of the leather cords 102, 202, 104, 204 where a knot is crafted for additional strength and to prevent the gemstones 300 from falling off. After the knot 302 is finished and located below the gemstones 300, a strap mounting ball 128, 228 is place over the end of the leather cord 102, 202, 104, 204 and crimped to the end of the leather cord 102, 202, 104, 204. It should be appreciated that covers may then be added to the end of the leather cord 102, 202, 104, 204 to provide additional protection to the end of the leather cord 102, 202, 104, 204.

Figure 7B:
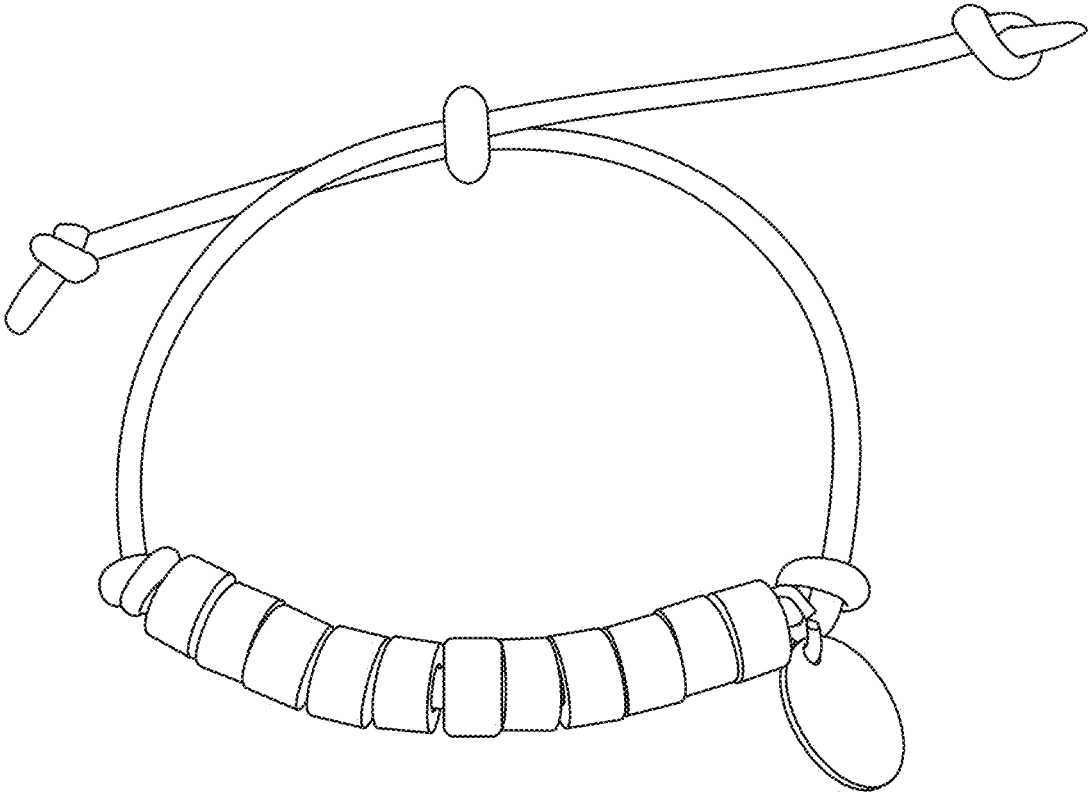
FIG. 7B shows a side view of a jewelry bracelet of FIG. 1, in accordance with another embodiment of the invention.
Figure 8:
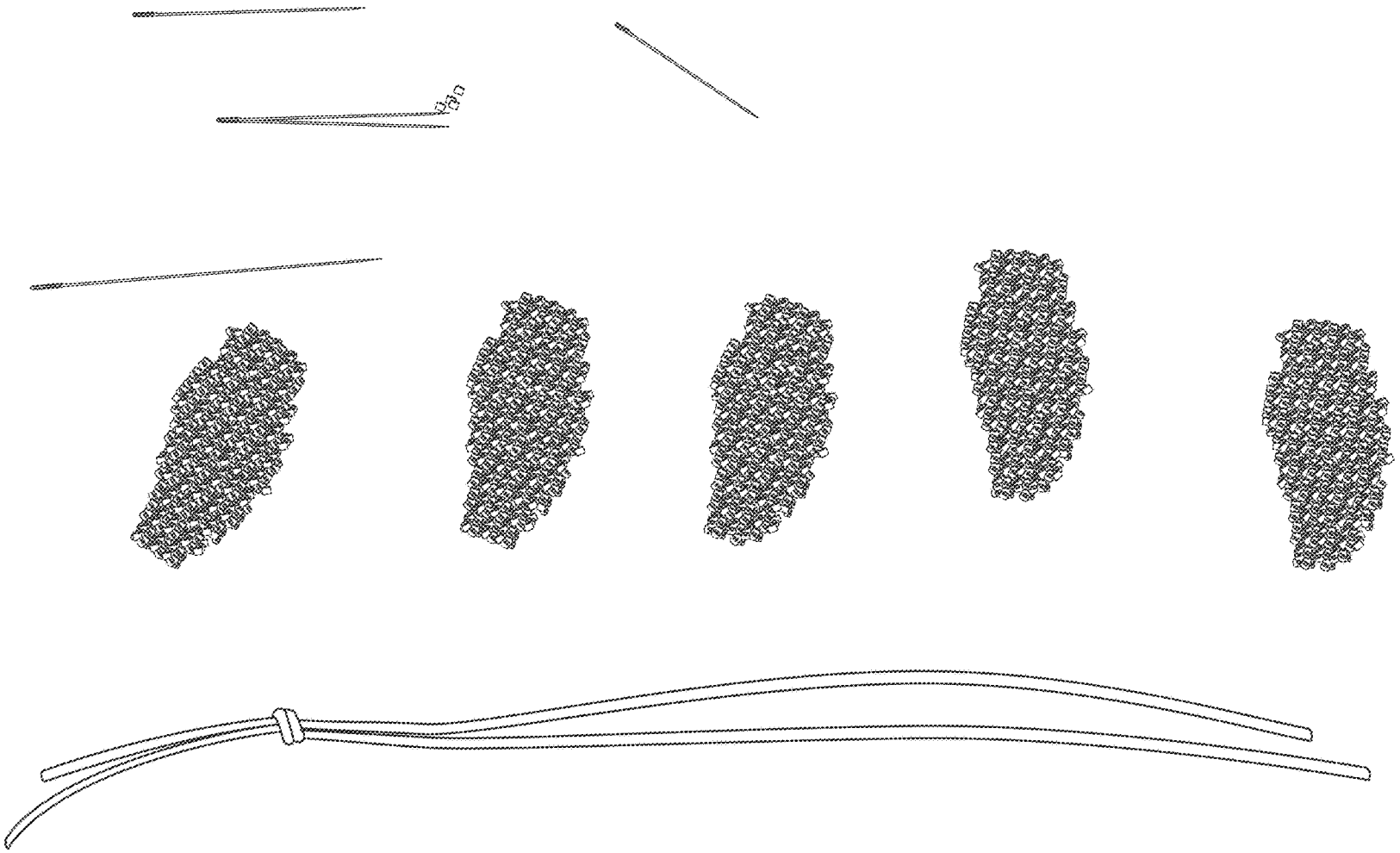
FIG. 8 shows some of the components used to construct the jewelry bracelet of FIG. 1 and FIG. 4A, in accordance with an embodiment of the invention.
Figure 9:
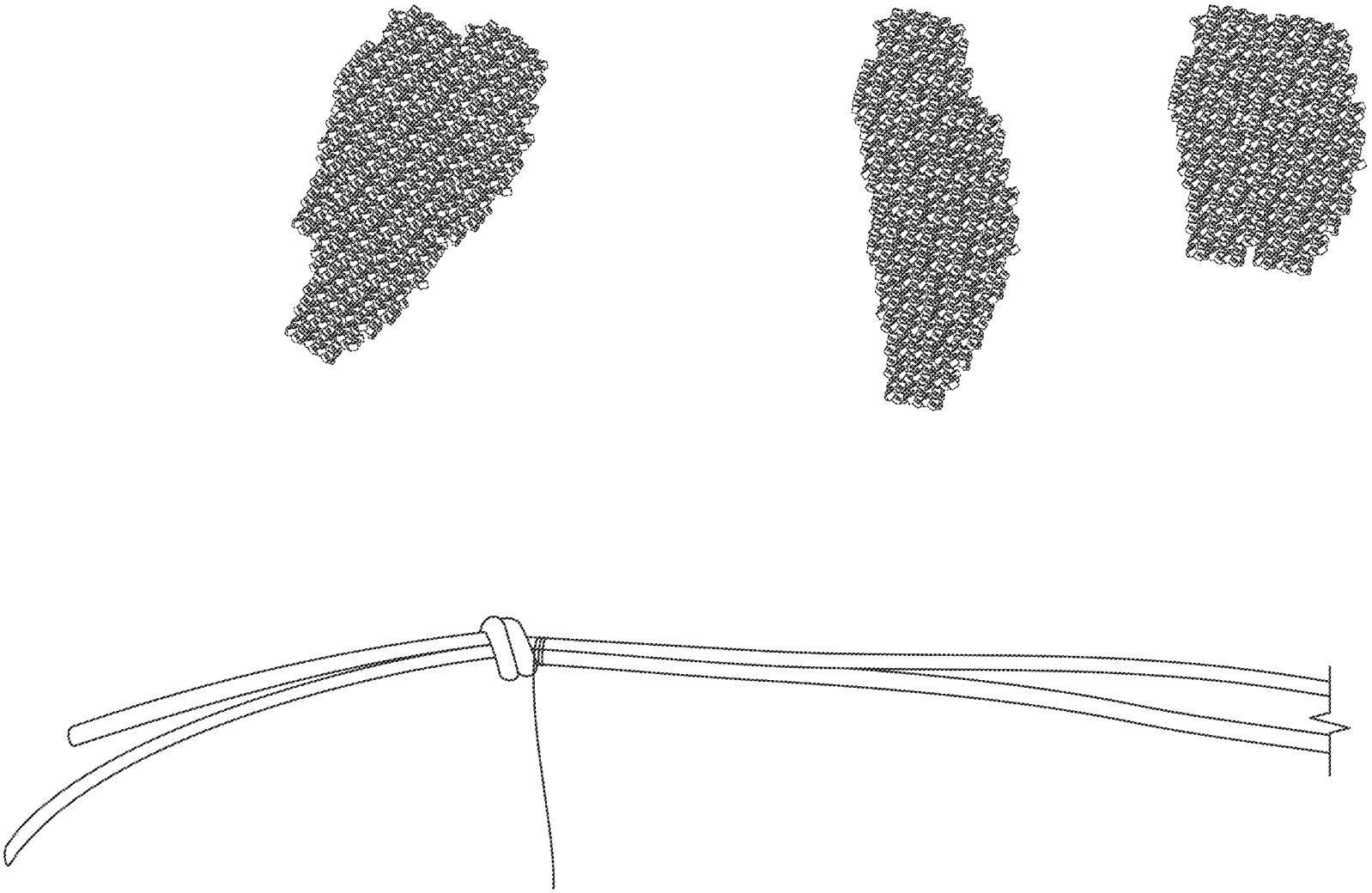
FIG. 9 shows the first end of the bead mounting thread being associated with the first strap and second strap of the bracelet of FIG. 1 and FIG. 4A, in accordance with an embodiment of the invention.
Figure 10:
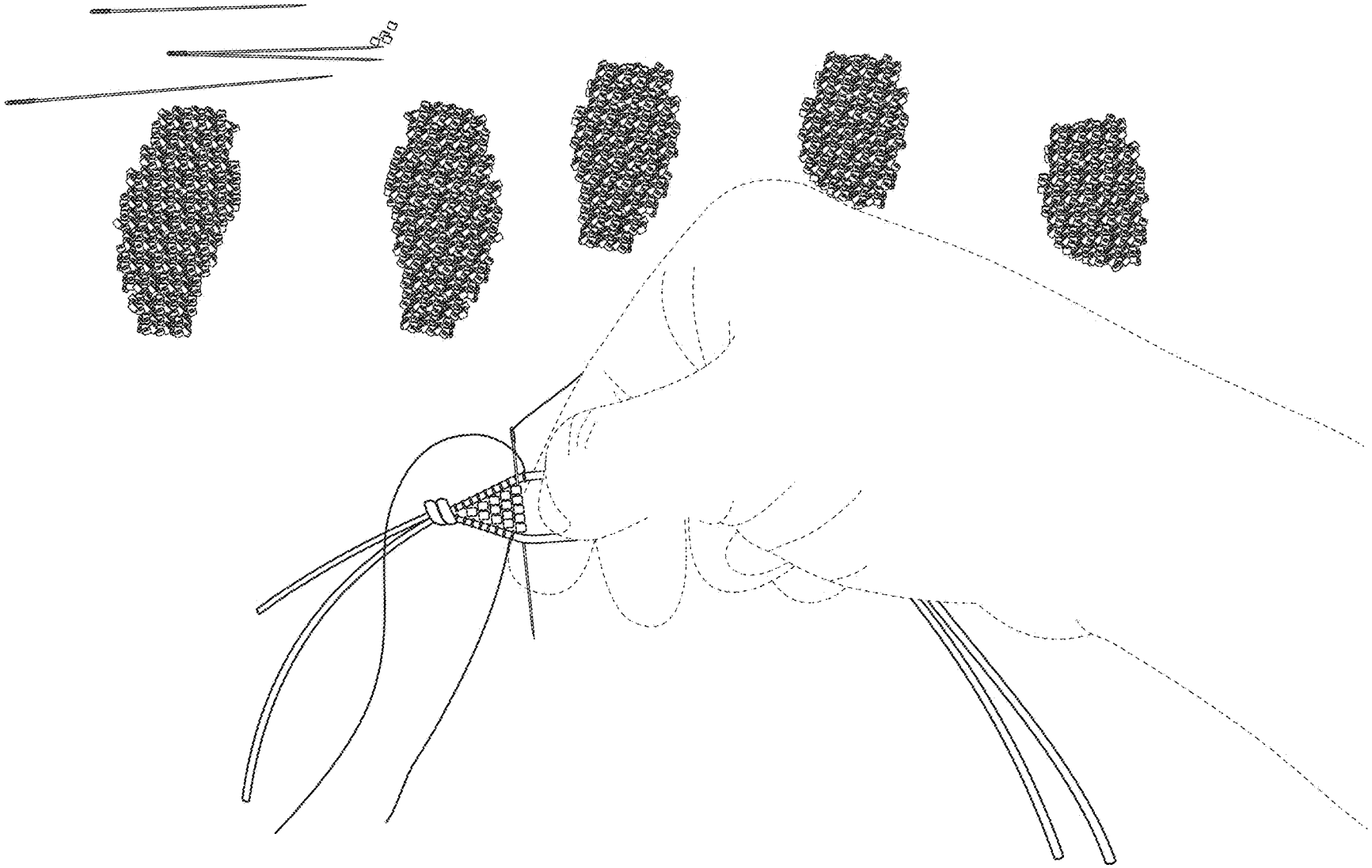
FIG. 10 shows the glass seed beads being associated with the first strap and second strap of the bracelet of FIG. 1 and FIG. 4A, in accordance with an embodiment of the invention.
Figure 11:
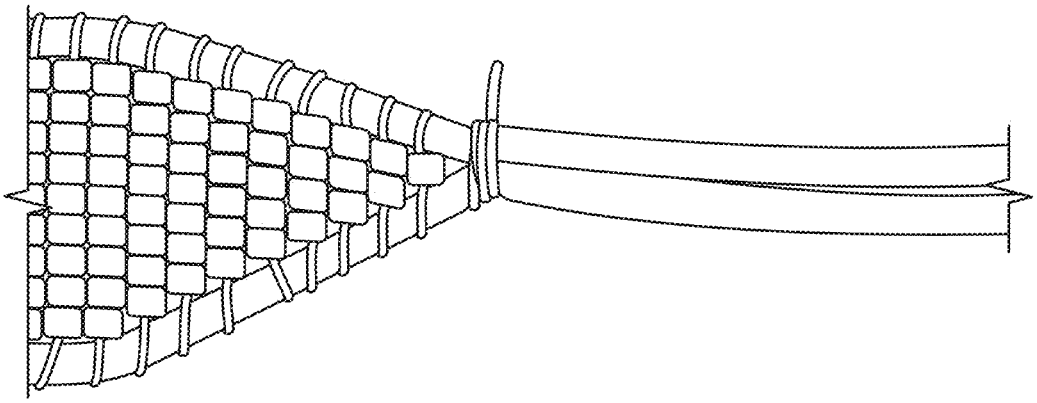
FIG. 11 shows the second end of the bead mounting thread being associated with the first strap and second strap of the bracelet of FIG. 1 and FIG. 4A, in accordance with an embodiment of the invention.
Figure 12:
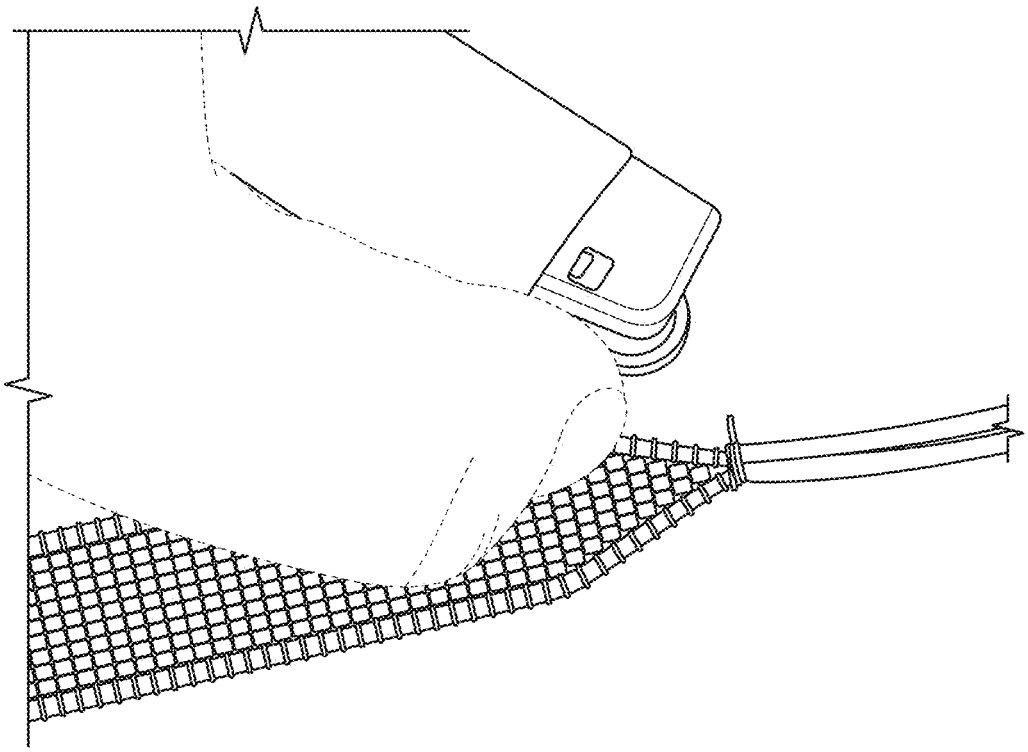
FIG. 12 shows the second end of the bead mounting thread of FIG. 11 being trimmed, in accordance with an embodiment of the invention.
Figure 13:
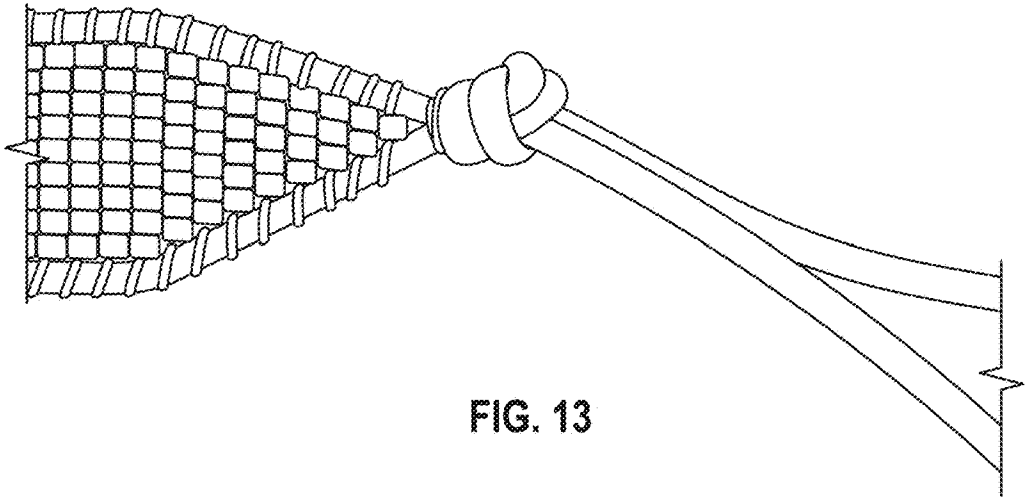
FIG. 13 shows the first strap second end being tied to the second strap to form the second knot, in accordance with an embodiment of the invention.
Figure 14:
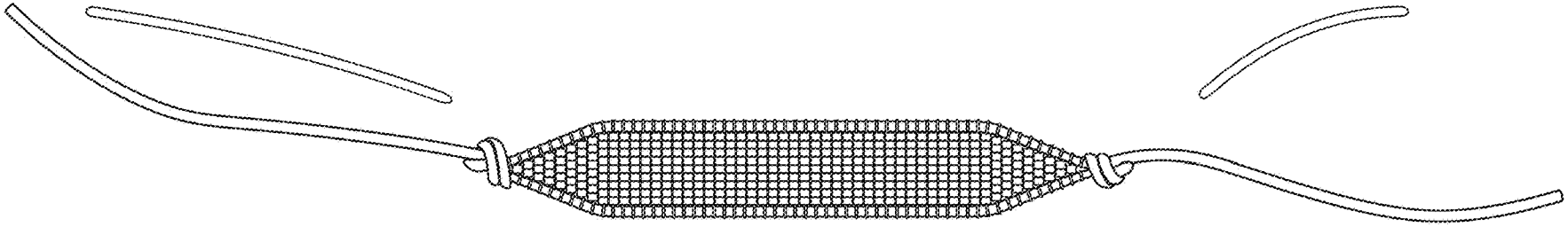
FIG. 14 shows the bracelet of FIG. 1 and FIG. 4A partially constructed, in accordance with an embodiment of the invention.
Figure 15:
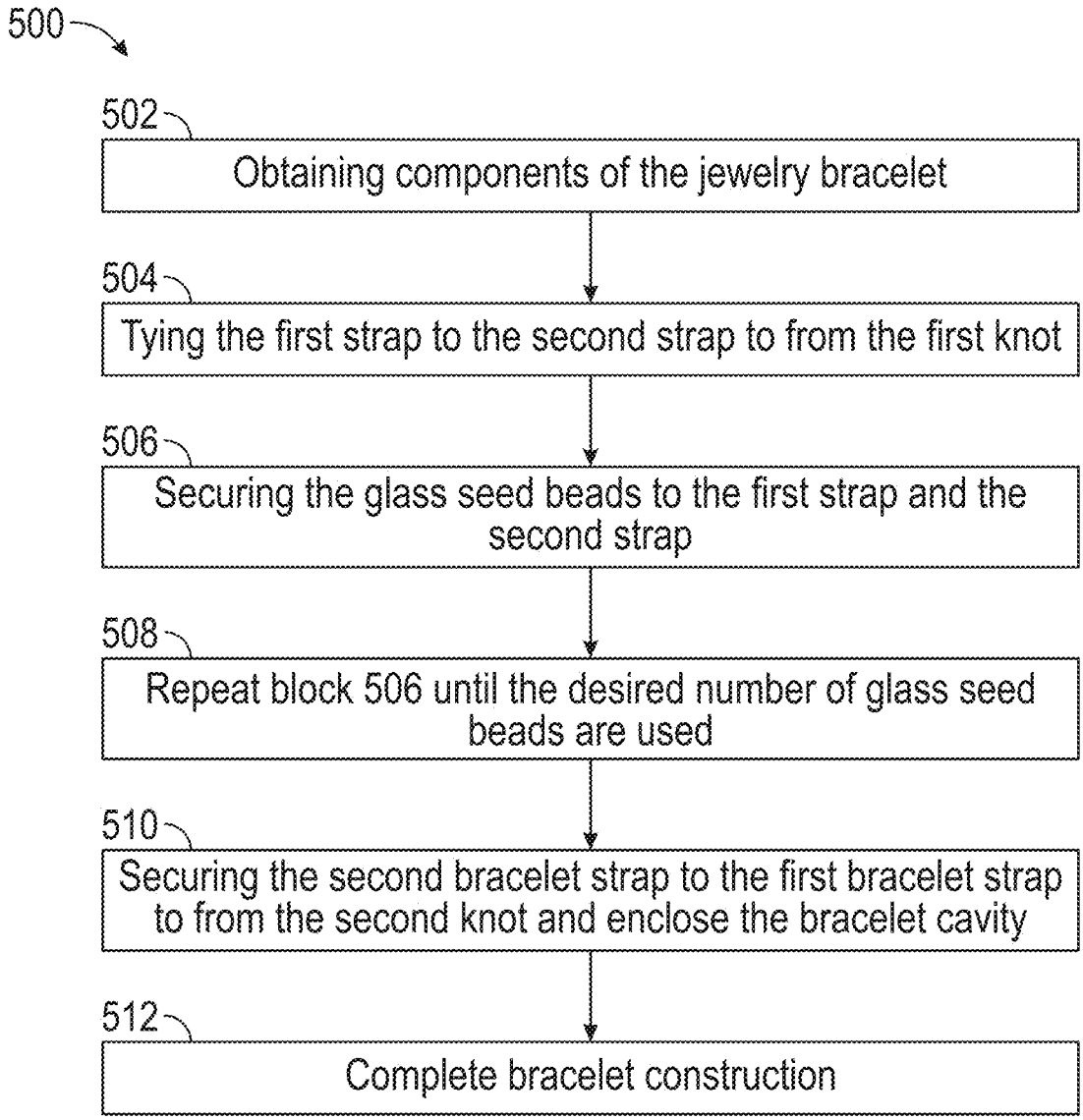
FIG. 15 shows an operational block diagram illustrating a method for creating a jewelry bracelet, in accordance with an embodiment of the invention.

Referring to FIG. 7B, still yet another embodiment of a bracelet 300 is shown and includes a strand of material (multiple strands of leather or some other material may be used as desired) having a first knot on one end. Then stones/gems having holes therethrough are associated with the strand of material by thread the strand of material through the holes and creating a second knot on the other end of the strand of material such that the stones/gems are located between the first knot and the second knot. This may be accomplished by placing the strand of material into holes of the metal beads with silicone glide mechanism. Then each end of the strand of material may then be threaded though the center ring cavity 134, 234 of the center ring 124, 224 and each end of the strand of material may be knotted to prevent the ends of the strand of material from slipping out of the center ring cavity 134, 234.

Referring to FIG. 8, FIG. 9, FIG. 10, FIG. 11, FIG. 12, FIG. 13, FIG. 14 and FIG. 15, a method 500 for creating a jewelry bracelet 100, 200 is provided and disclosed, in accordance with an embodiment of the invention. The method 500 includes obtaining a first bracelet strap (or cord) 102, 202, a second bracelet strap (or cord) 104, 204, a strap center pad 106, 206, a plurality of glass seed beads 146, 246 and at least one bead mounting thread 148, 248, as shown in operational block 502. One end of the first bracelet strap 102, 202 is tied to the second bracelet strap 104, 204 to form a first knot 150, 250 and one end of the at least one bead mounting thread 148, 248 is secured to the first bracelet strap 102, 202 by tying the at least one bead mounting thread 148, 248 to the first bracelet strap 102, 202 proximate the first knot 150, 250, as shown in operational block 504. The bead mounting thread 148, 248 is then threaded through one or more of the glass seed beads 146, 246 and secured to both the first bracelet strap 102, 202 and second bracelet strap 104, 204 such that the glass seed beads 146, 246 are tightly and securely located within the bracelet cavity 154, 254 between the first bracelet strap 102, 202 and second bracelet strap 104, 204, as shown in operational block 506. This is repeated until the number of glass seed beads 146, 246 as desired to complete bracelet 100, 200 is used and the remaining length of the bead mounting thread is tied to the first bracelet strap 102, 202 and second bracelet strap 104, 204, as shown in operational block 508. It should be appreciated that the glass seed beads 146, 246, may be selected and arranged by color to form a desired design.

The method 500 further includes securing the second bracelet strap 104, 204 to the first bracelet strap 102, 202 to form a second knot 152, 252 to enclose the bracelet cavity 154, 254, around the plurality of glass seed beads 146, 246, as shown in operational block 510. The bracelet 100, 200 may then be completed, as shown in operational block 512. This may be accomplished by securely associating the strap center pad 106, 206 to the bracelet proximate the bracelet cavity 154, 254 and by associating one or more of the plurality of center rings 224, two strap end rings 226 and two strap mounting balls 228 to the loose ends of the first strap 102, 104 and the second strap 104, 204. This may be accomplished by threading the first strap 102, 202, and the second strap 104, 204 through the center ring cavity 134, 234 and the strap end ring cavity 140, 240 and located the ends of the first strap 102, 202, and the second strap 104, 204 within the mounting ball cavity 144, 244. It should be appreciated that the strap center pad 106, 206 may be associated with the bracelet 100, 200 via any method and/or device suitable to the desired be purpose, such as, for example, via glue, Velcro®, stitching, etc. For example, in an embodiment, the strap center pad 106, 206 may be associated with an inner side (i.e., wrist side) of the bracelet cavity 154, 254 proximate the wrist of the user using an adhesive to adhere the strap center pad 106, 206 to the first strap 102, 202 and the second strap 104, 204.

It should be appreciated that the gemstones used in the invention are cleansed via a traditional Native American sage ceremony which is used by practitioners of energy healing to use the stones as a mechanism for energy protection and healing.

It should be appreciated that while the invention has been described with reference to an exemplary embodiment, it will be understood by those skilled in the art that various changes, omissions and/or additions may be made, and equivalents may be substituted for elements thereof without departing from the spirit and scope of the invention. In addition, many modifications may be made to adapt a particular situation or material to the teachings of the invention without departing from the scope thereof. Moreover, it is contemplated that elements of one embodiment may be combined with elements of other embodiments as desired. Therefore, it is intended that the invention not be limited to a particular embodiment disclosed herein as the best mode contemplated for carrying out this invention, but that the invention will include all embodiments (individually and/or combined) falling within the scope of the appended claims and/or information. Moreover, unless specifically stated any use of the terms first, second, etc. do not denote any order or importance, but rather the terms first, second, etc. are used to distinguish one element from another.

What is claimed is:

1. A jewelry bracelet, comprising, a first strap having a first strap first end, a first strap second end and a first strap length;

a second strap having a second strap first end, a second strap second end and a second strap length, wherein the first strap first end is tied to the second strap along the second strap length and the second strap first end is tied to the first strap along the first strap length to define a bracelet cavity;

a plurality of bead lines, wherein the plurality of bead lines are associated with the first strap and the second strap via a mounting thread to be securely and tightly disposed within the bracelet cavity; and a center ring defining a center ring cavity, wherein the first strap second end and the second strap second end are securely associated with the center ring to define a wrist cavity.

2. The jewelry bracelet of claim 1, wherein the first strap second end and the second strap second end are threaded through the center ring cavity such that a portion of the first strap and the second strap are disposed with the center ring cavity.

3. The jewelry bracelet of claim 1, further comprising a first strap end ring defining a first strap end ring cavity, and a second strap end ring defining a second strap end ring cavity.

4. The jewelry bracelet of claim 3, wherein the first strap second end is threaded through the first strap end ring cavity such that a portion of the first strap is disposed with the first strap end ring cavity, and the second strap second end is threaded through the second strap end ring cavity such that a portion of the second strap is disposed with the second strap end ring cavity.

5. The jewelry bracelet of claim 4, further comprising, a first end knot disposed on the first strap second end and a second end knot disposed on the second strap second end.

6. The jewelry bracelet of claim 5, further comprising, a first end mounting ball securely associated with the first strap second end such that the first end knot is disposed between the first end mounting ball and the first strap end ring; and a second end mounting ball securely associated with the second strap second end such that the second end knot is disposed between the second end mounting ball and the second strap end ring.

* * * * *